United States Patent [19]

Marom

[11] Patent Number: 4,576,248

[45] Date of Patent: Mar. 18, 1986

[54] RESCUE AND GLIDER DEVICE

[76] Inventor: Dan Marom, Tamar Street 32/1, Neve Monosson, Israel

[21] Appl. No.: 725,008

[22] Filed: Apr. 19, 1985

[30] Foreign Application Priority Data

May 2, 1984 [IL] Israel ..... 71719

[51] Int. Cl.[4] ..... A62B 1/14

[52] U.S. Cl. ..... 182/5; 188/65.4

[58] Field of Search ..... 182/5, 6, 7, 8; 188/65.4, 65.5

[56] References Cited

U.S. PATENT DOCUMENTS

| | | | |
|---|---|---|---|
| 269,268 | 12/1882 | Davis | 182/5 |
| 302,231 | 7/1884 | Bishop | 182/7 |
| 394,109 | 12/1888 | Fowler | 188/65.5 |
| 398,826 | 3/1889 | Fowler | 188/65.5 |
| 544,724 | 8/1895 | Cotton et al. | 188/65.5 |
| 770,012 | 9/1904 | Kramer | 182/6 |
| 3,250,515 | 5/1966 | Hudnall | 188/65.4 |
| 3,357,520 | 12/1967 | Foote | 182/5 |
| 4,474,262 | 10/1984 | Himmelrich | 182/5 |

FOREIGN PATENT DOCUMENTS

| | | | |
|---|---|---|---|
| 18581 | of 1905 | United Kingdom | 182/5 |

*Primary Examiner*—Reinaldo P. Machado

*Attorney, Agent, or Firm*—Fleit, Jacobson, Cohn & Price

[57] ABSTRACT

A rescue and glider device for use of persons operating at great height from which they might fall comprises a casing through which is passed a rope which is automatically clamped in the casing, so braking the fall of the person to whom the device is attached, the rope being affixed at some point at the height at which the person operates or even higher up.

6 Claims, 6 Drawing Figures

RESCUE AND GLIDER DEVICE

FIELD AND BACKGROUND OF INVENTION

The present invention concerns a rescue and glider device to be used by parachutists, firemen, mountain climbers, roof layers or any other person who does work at great heights and thus is in danger of falling therefrom.

The invention further concerns a rescue and glider device of the kind which can be operated by another person to safely rescue an endangered person from great heights and lower that person to the ground.

The main difficulty for a person who operates at great heights and inadvertently falls therefrom is the fact that he may become panicky and therefore fail to be able to operate any of the known rescue appliances.

Furthermore, when a person is to be lowered from heights by any of the known rescue appliances, a complicated supporting mechanism including either a tripod or complicated tackle mechanism for supporting said appliance is required. These rescue appliances also require a schooled technician to operate them.

A still further drawback of the known rescue appliances is the fact that they require generally twice the length of rope or cable than the height scaled or at least an additional long safety cord.

OBJECTS OF INVENTION

It is the object of the present invention to provide a glider and rescue device for the purposes aforesaid which automatically is actuated when a load is applied thereon, i.e. when the person to whom the device is attached falls freely. It is a further object of the present invention to provide a rescue device with which all the abovementioned drawbacks are overcome.

SHORT SUMMARY OF DISCLOSURE

The invention consists in a rescue and glider device for the use of persons working or operating at great height from the ground and being in danger of falling.

According to the invention there is provided a device comprising a shallow housing and a cable, an inlet opening for the cable and an outlet opening for the cable, a substantially T-shaped lever, the leg of the T-shape extending to the outside of the casing and being pivotally mounted within the housing at the juncture of the leg and webs of the T-shape, one part of the web of the lever—which is at one side of the leg—extending toward said inlet opening and being longer than the distance from said pivot to the corresponding side wall of the housing, the other part of the web at the opposite side of the leg extending towards the outlet opening, guide means being provided to guide the cable from the inlet towards the web of said lever, the automatic rotation of said lever into a cable locking position being caused and accomplished by a load on said cable, while the release thereof is effected by the manual rotation of said lever.

It is envisaged that any person working at great heights will be provided with a rescue device according to the invention. One cable end will be anchored at the working height and from there the cable leads through the housing around said guide means and said lever to the ground. The device may be attached to the worker by any means, e.g. the cable leaving the housing may be wound around the person before extending to the ground. If now the person should fall, the weight of his body will cause the lever to rotate and clamp the cable within the housing, so that no further downward movement of the person is possible. If the person is not panicky, he can lower himself to the ground by rotating the lever handle and thus release the clamping action of the lever. If, however, the person is in shock or is hurt, and is incapable of operating the lever handle, he will remain in depending position until rescued by suitable means.

SHORT DESCRIPTION OF DRAWINGS

The invention is illustrated by way of example only in the accompanying drawings in which.

DETAILED DESCRIPTION OF A PREFERRED EMBODIMENT

Figure 2:
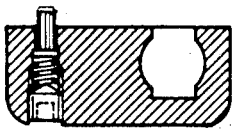
FIG. 2 is a section taken along line II—II of FIG. 1.
Figure 3:
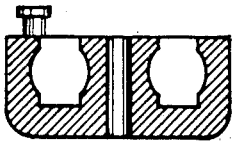
FIG. 3 is a section taken along line III—III of FIG. 1.
Figure 1:
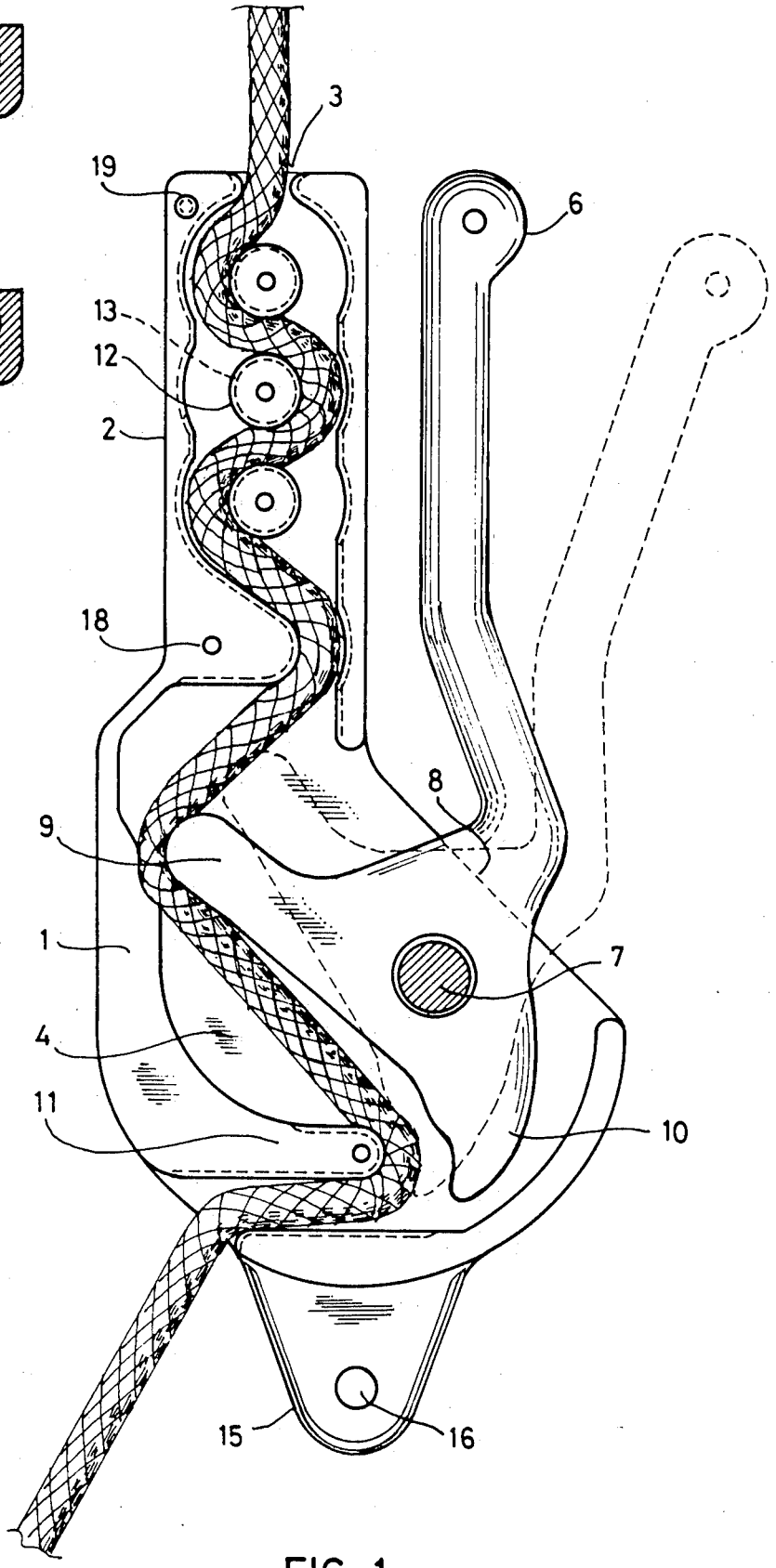
FIG. 1 is a plan view of the device with its cover removed, the handle being shown in its two extreme positions of operation.
Figure 4:
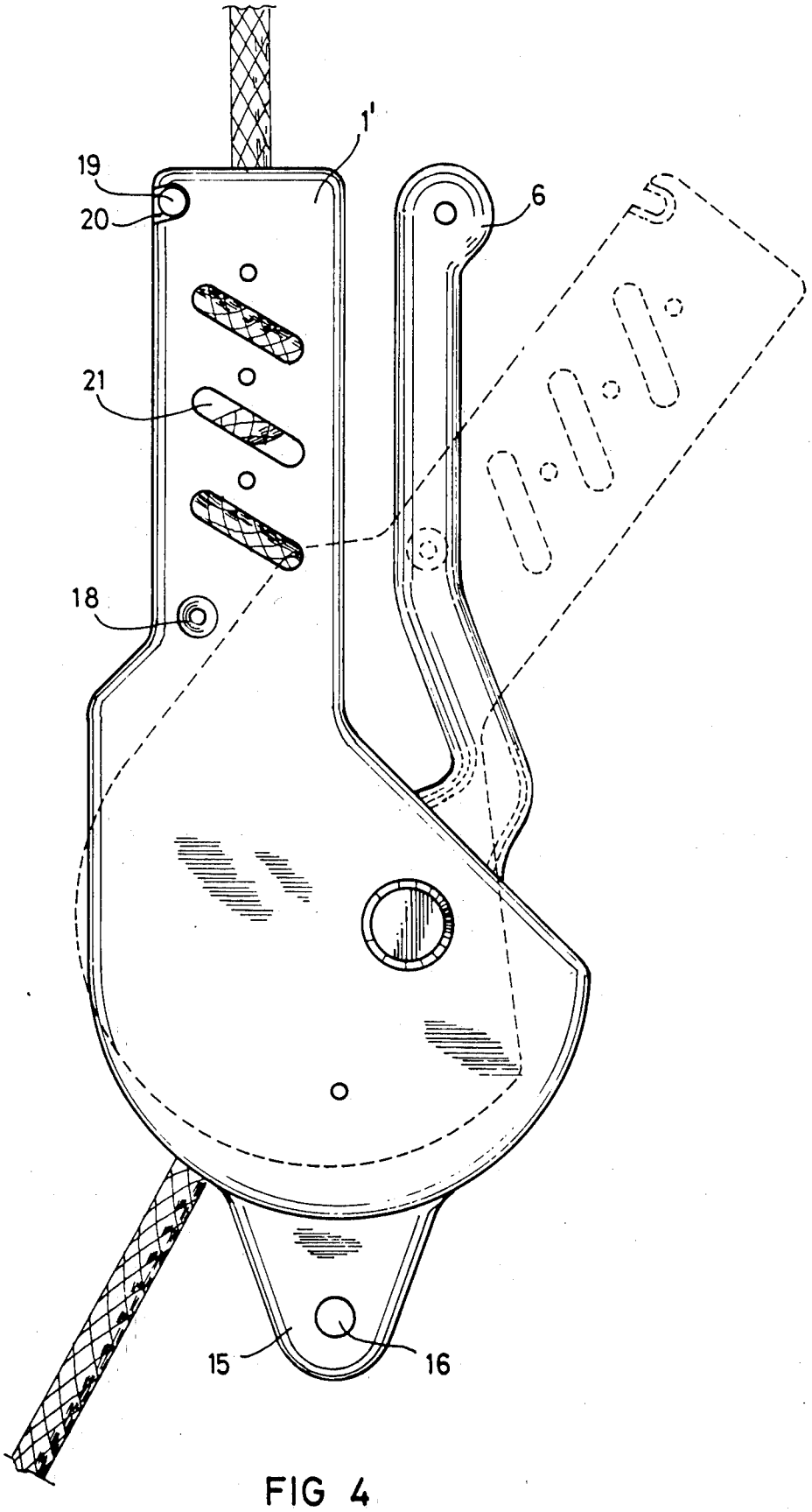
FIG. 4 is a plan view of the device housing with its cover, the open position of the cover being shown in dotted lines.
Figure 6:
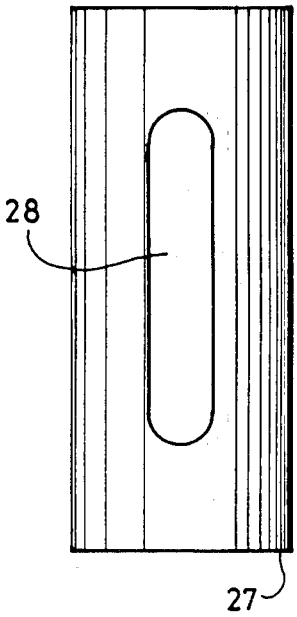
FIG. 6 is a fractional plan view of a sheath like cover used in the embodiment of the invention according to FIG. 5.
Figure 5:
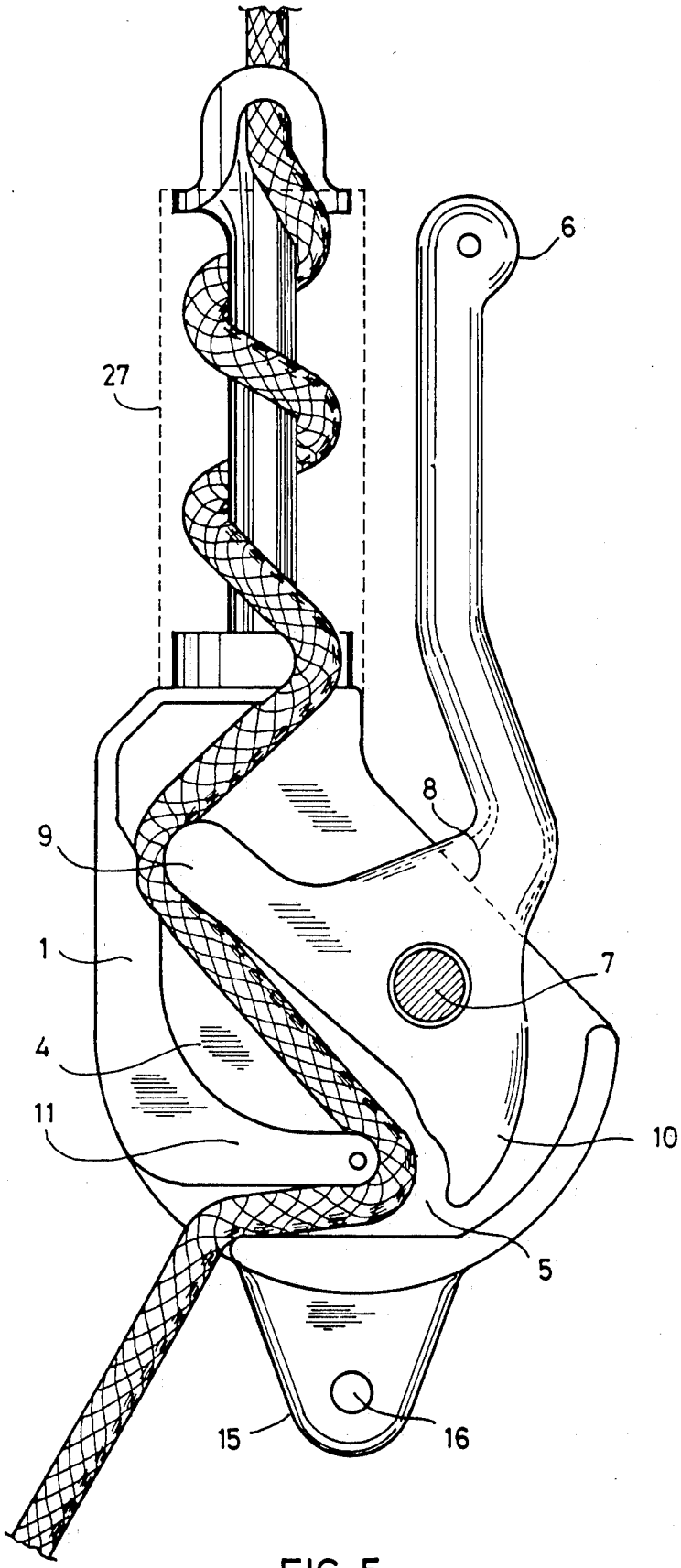
FIG. 5 is a partial plan view of a second embodiment of the invention.

The device according to the invention comprises an elongated shallow housing 1, having a narrower top part 2 with an inlet 3 for a cable and a wider bottom part 4 with an outlet 5 for said cable. A substantially T-shaped lever 6 is pivotally attached at 7 within the bottom part 4 of the housing, an opening 8 being provided in the wall of the housing for the leg of lever 6 to extend therethrough and be movable therein, said leg extending adjacent top part 3. The web part 9 of the lever which faces towards the top part 2 and its inlet 3 is longer than the distance from pivot 7 to the corresponding side wall, while the web part 10 faces the outlet 5 and is shorter than web part 9. An abutment 11 for web part 10 extends integrally from the side wall of the housing towards said web part.

In the top part 2 of the housing three vertically aligned cylindrical guide bosses 12 are provided between the inlet 3 and the bottom of said part, the guide bosses 12 as well as the walls facing them being undercut by rounded walls 13 for a purpose which will become clear hereinafter. A tab 15 with eyelet 16 is integrally made with and extends sidewards from the bottom of the housing.

The housing is covered by a cover 1', which is a flat plate substantially of the same profile as the housing 1 and is pivotally attached to the housing at pivot 7. A spring loaded pin 17 is mounted in an aperture in the wall of the housing and engages, when the cover 16 is closed, in a hole 18 in cover 1'.

The housing is provided at one top corner with a pin 19 which is engaged by a notch 20 made in the cover when the latter is closed. Slots 21 are provided on the cover for a purpose which will become clear hereinafter.

As has been mentioned above, the insides of the walls of the housing as well as the guide bosses 12 and the parts of the webs 9 and 10, and the housing side walls which will come into contact with the cable as will hereinafter be described, are all undercut, i.e. they are partially hollowed out with a radius corresponding to that of the cable 22.

FUNCTION AND OPERATION

The device works as follows. It is envisaged that each person working at great heights will be provided with a rescue device according to the invention, which is strapped to his body by eyelet 16 at a convenient position so that he can manipulate lever 6 when required. One cable end will be anchored at the working height and from there the cable leads to the inlet 3 of the housing. At the outset when the cover 16 is pivoted to expose guide bosses 12, a cable 22 is threaded around them, and around web 9 and abutment 11 through outlet 5 to the ground. If now the person should fall from the height, or wants to lower himself to the ground from said height, the weight of his body will cause the approach of web part 10 towards the abutment 11, thereby clamping the cable between them so that the device, i.e. the person strapped to it can move no further. Thus the fall of the worker will be arrested. If now the worker moves the handle of lever 6 slowly towards housing part 2, the engagement of the cable by web 10 will be released, while web part 9 will move slowly towards the wall of housing 1 and thereby allow the sliding of the device relative the cable and thus of the worker. A firm pull of lever handle 6 so that it will lie adjacent housing part 2 will again cause the cable to be wedged between web 9 and the housing wall and will again arrest the movement of the device.

Alternatively, the person can be lowered by holding first the lever handle 6 towards the housing thereby clamping the cable between part 9 and the wall of the housing and then releasing it slowly to permit the movement of the device relative the cable, whereafter the pressure is released. The sliding will stop because web part 10 will clamp the cable onto abutment 11.

If the device is attached at a certain height by means of tab 15 and eyelet 16, a person, who is attached to the cable, e.g. through the intermediary of a harness, may be slowly lowered to the ground by an operator actuating lever handle 6.

Ventilation holes 23 are provided in the housing in order to cool it from the heat created by the friction of the cable. The slots 21 serve the same purpose.

In a second embodiment of the invention, the top part 2 of the housing may be eliminated and replaced by a post 24 having at its top an integral tab 25 with an eyelet 26 through which the cable can be threaded. The post 24 may be covered by a sheath like cover 27 having a ventilation slot 28. In this case the pivotal cover for the housing extends over its bottom part only.

It can be seen that the speed of sliding the device along the cable can be easily controlled by the operation of the handle, so that any unskilled operator can actuate the device.

I claim:

1. A rescue and glider device for the purpose aforesaid comprising a shallow housing, a cable, an inlet opening for the cable and an outlet opening for the cable, a substantially T-shaped lever, the leg of the T-shape extending to the outside being pivotally mounted within the housing at the juncture of the leg and webs of the T-shape, one part of the web of the lever which is at one side of the leg extending toward said inlet opening and being longer than the distance from said pivot to the corresponding side wall of the housing, the other part of the web at the opposite side of the leg extending towards the outlet opening, guide means being provided to guide the cable from the inlet towards the web of said lever, the automatic rotation of said lever into a cable locking position being caused and accomplished by a load on said cable, while the release thereof is effected by the manual rotation of said lever.

2. A rescue and glider device as claimed in claim 1, wherein the inlet is at the end of a narrower part of the housing, the outlet being near the end of a wider part of the housing.

3. A rescue and glider device as claimed in claim 2, wherein the guide means are linearly spaced, aligned guide bosses provided in the narrower part of the housing.

4. A rescue and glider device as claimed in claim 1, wherein any of the side walls with which the cable is to be in contact is undercut with a radius corresponding to that of the cable.

5. A rescue and glider device as claimed in claim 1, wherein a cover is pivotally attached to the open side of the housing.

6. A rescue and glider device as claimed in claim 1, wherein the guide means are a post attached to the housing having an integral tab with an eyelet at its free end, the cable being adapted to be threaded through said eyelet and around said post to be inserted into the inlet opening of the housing.

* * * * *